US006295771B1

(12) United States Patent
Desjoyaux et al.

(10) Patent No.: US 6,295,771 B1
(45) Date of Patent: Oct. 2, 2001

(54) PANELS FOR CONSTRUCTING SWIMMING POOLS

(75) Inventors: Jean Louis Desjoyaux, L'Etrat; Pierre Louis Desjoyaux, La Fouillouse; Catherine Jandros, L'Etrat, all of (FR)

(73) Assignee: Piscines Desjoyaux, S.A. (FR)

( * ) Notice: Subject to any disclaimer, the term of this patent is extended or adjusted under 35 U.S.C. 154(b) by 0 days.

(21) Appl. No.: 09/462,610

(22) PCT Filed: Jun. 29, 1998

(86) PCT No.: PCT/FR98/01376

§ 371 Date: Mar. 27, 2000

§ 102(e) Date: Mar. 27, 2000

(87) PCT Pub. No.: WO99/02802

PCT Pub. Date: Jan. 21, 1999

(51) Int. Cl.[7] ..... E02D 27/00

(52) U.S. Cl. ..... 52/169.7; 52/578; 52/568; 52/238.1

(58) Field of Search ..... 52/578, 586, 238.1, 52/169.7

(56) References Cited

U.S. PATENT DOCUMENTS

| | | | | |
|---|---|---|---|---|
| D. 415,580 | * | 10/1999 | Keating et al. | 52/238.1 |
| 4,047,340 | | 9/1977 | Witte et al. . | |
| 4,797,983 | | 1/1989 | Barnett et al. . | |
| 4,847,926 | | 7/1989 | Laputka . | |
| 5,259,164 | * | 11/1993 | Wiese | 52/586 |
| 5,313,751 | * | 5/1994 | Wittler | 52/238.1 |

FOREIGN PATENT DOCUMENTS

| | | |
|---|---|---|
| 0382649 | 8/1990 | (EP) . |
| 95/25864 | 9/1995 | (WO) . |

* cited by examiner

*Primary Examiner*—Carl D. Friedman
*Assistant Examiner*—Chi Q. Nguyen
(74) *Attorney, Agent, or Firm*—Wall, Marjama & Bilinski

(57) ABSTRACT

Panels used in the construction of swimming pools, each having a rectangular shape with a peripheral frame defining vertical wings to be assembled with adjacent panels. One of the wings has over its entire height centering and sealing devices consisting of a section that overlaps the outer surface of the wing and a lateral sealing lip. Each section cooperates with a matching hollow shape on the other wing. The section and the hollow shape having a triangular cross-section and a catching member for rapid assembly.

4 Claims, 5 Drawing Sheets

PANELS FOR CONSTRUCTING SWIMMING POOLS

The invention relates to the technical field of structural parts for swimming pools.

BACKGROUND OF THE INVENTION

It is widely known that swimming pools can be built by using independent modular panels that are fitted together in various shapes to produce a swimming pool as such. In particular, the invention concerns panels of the type described in Patent EP 0382649, of which the present Applicant is also the holder. Each panel of a generally rectangular shape has a peripheral frame that delimits vertical wings for joining it to adjacent modular panels. Each modular panel has a relatively narrow width compared with its height. For information, the height of these modular panels is four times their width. Advantageously, they are roughly 1.2 m high and roughly 25 cm wide.

In particular and as is apparent from claim 1 in abovementioned Patent EP 0382649, the panel comprises a prefabricated structure and a reinforcing element having a cross-section designed to contain, over its entire height, concrete that is in contact with an anchorage, characterised in that:

- the structure and the reinforcing element are two independent elements which, after assembly, constitute said panel.
- the prefabricated structure is of a generally quadrangular shape and has vertical wings which accommodate, in pairs, complementary fixing attachments which allow assembly with another juxtaposed structure.
- the reinforcing element has a transverse cross-section capable of defining a vertical trough that opens out into a squared edge and said trough and said edge contain the concrete in combination with the anchorage.
- the vertical trough is formed between two support and fixing wings situated in the same plane in order to ensure separate fixing of the reinforcing element between the wings of the structure, the width of the element, at the level of the wings, corresponding very substantially to the width between the inner faces of the wings
- the reinforcing element and the structure are made of reinforced concrete.

The various modular panels can be joined together by various means. For instance, the vertical wings of the frames have a plurality of oblong slots to accommodate assembly fittings after the elements have been placed side by side. It is clear that this solution is relatively time-consuming, given the fact that the operator must fit each assembly fitting in the various slots and then tighten these assembly fittings.

In another embodiment, the wings may have, in pairs, fixing attachments of the tenon and mortise type that can be deformed by a heat source—these too require external means.

In addition, after joining the various juxtaposed modular elements, it is necessary to ensure that the joints between the elements are leaktight, especially at the interstice produced by placing them side by side. This sealing operation is generally performed by applying a weld bead along all the separation gaps. Once again, these operations are time consuming and the result obtained is not always very satisfactory.

As stated, the outer face of these modular elements, i.e. that located on the same side as the peripheral assembly frame, can advantageously be fitted with an independent separately mounted reinforcing element that acts as a shaft. Once again, such provisions are clearly described and illustrated in the aforementioned patent. Essentially, this type of element comprises a vertical trough the free end of which is terminated by a squared edge. After the modular panels have been fitted together, the squared edges are arranged in alignment and side by side in order to provide an upper anchorage for the pouring of concrete which is also poured into each of the vertical troughs in combination with reinforcement elements. This shaft can be fixed relative to the panels by bonding, welding or, if applicable, by means of separately mounted assembly fittings.

SUMMARY OF THE INVENTION

Given this state of the art, the problem which the invention aims to solve is to ensure instant assembly of the various modular elements without requiring the use of any separately mounted assembly fasteners with the aim of obtaining perfect sealing after assembly without resorting to any special, separate sealing operation.

Another problem which the invention aims to solve is to allow assembly of the reinforcing elements which act as a vertical shaft relative to the basic structure of the panels themselves, without the need for any means of assembling them in order to consequently achieve instantaneous, automatic locking.

In order to solve this problem:

- one of the vertical wings (1*a*) has, on the one hand, over its entire height, means of centring and sealing consisting of a profile (1*e*) which protrudes from the outer face of the wing in question (1*a*) and has a lateral sealing lip (1*f*), said profile cooperating with a matching hollow shape (1*g*) on the other wing (1*b*), profile (1*e*) and hollow shape (1*g*) having a substantially triangular cross section,
  - and, on the other hand, click-in type quick-assembly features (1*j*) which cooperate with matching features (1*k*) on said other wing (1*b*);
- the inner face of structure (1) is joined to studs (11) which have a head (111) and a centring part (112) designed to cooperate with a narrowed slot (2*a*) in reinforcing element (2), said studs and slots being distributed over the entire height of said structure.

In order to solve the problem of ensuring instantaneous assembly of the various panels with each other without the need to use separately mounted fittings for such assembly, the means of assembly consist of tongues which have a hooked retention area at their end, said tongues being distributed over the height of the wing and co-operating with matching through holes formed in the thickness of the other wing.

Advantageously, the head has an oblong shape and its width substantially matches the width of the widest part of the narrowed slot and is angled at 90° relative to the latter, said head being physically attached to the centring part in the form of a pin of generally parallelepiped shape that cooperates with the width of the smallest narrowed part of said slot.

The panel according to the invention is made of any material but, preferably, of a plastic material obtained by any known, appropriate manufacturing process.

BRIEF DESCRIPTION OF THE DRAWINGS

The invention is explained below in greater detail, reference being made to the following drawings in which.

DESCRIPTION OF THE INVENTION

Figure 1:
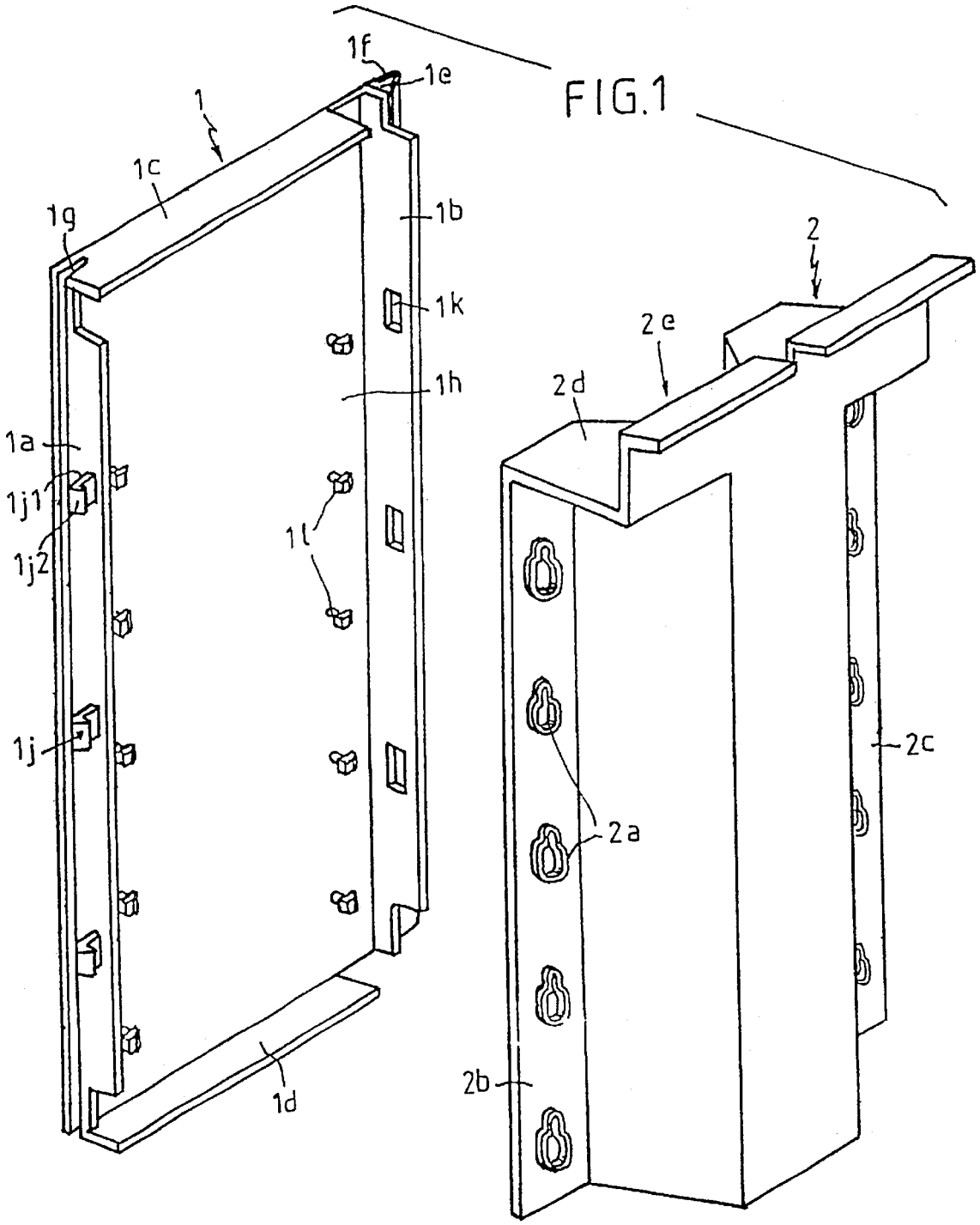
FIG. 1 is a perspective view of a modular panel element and the shaft before assembly.
Figure 2:
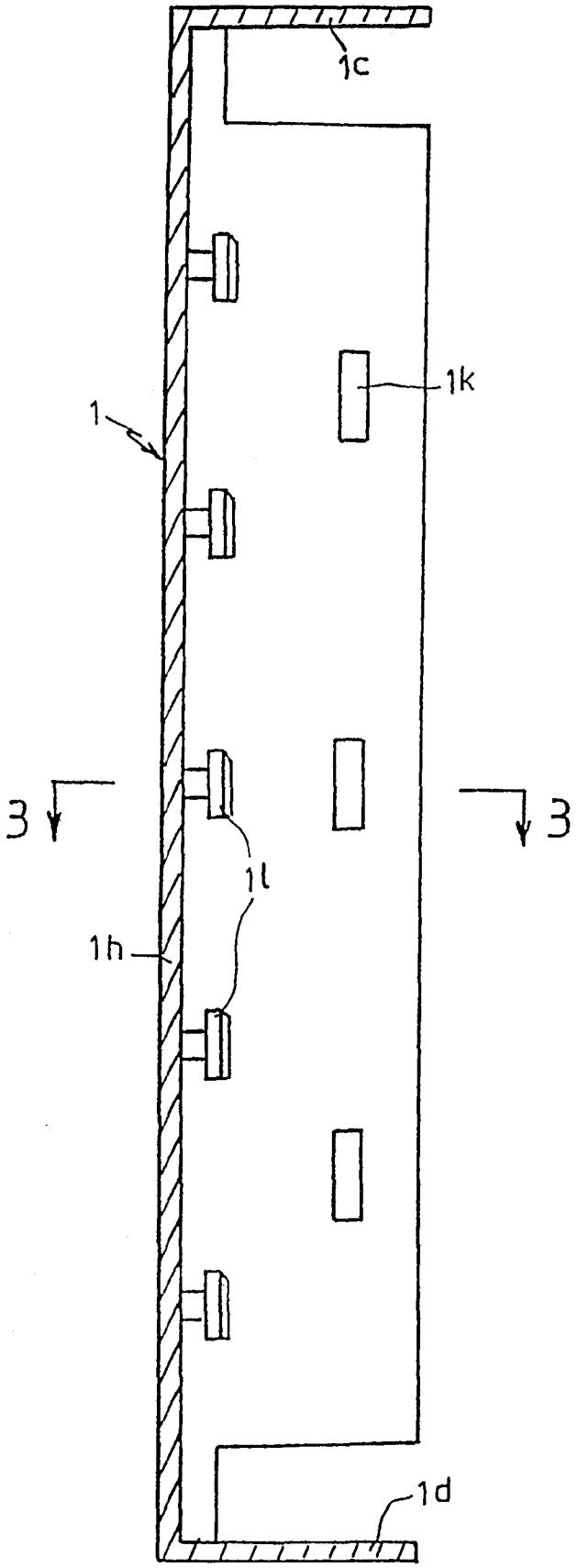
FIG. 2 is a longitudinal sectional view of the panel.
Figure 3:
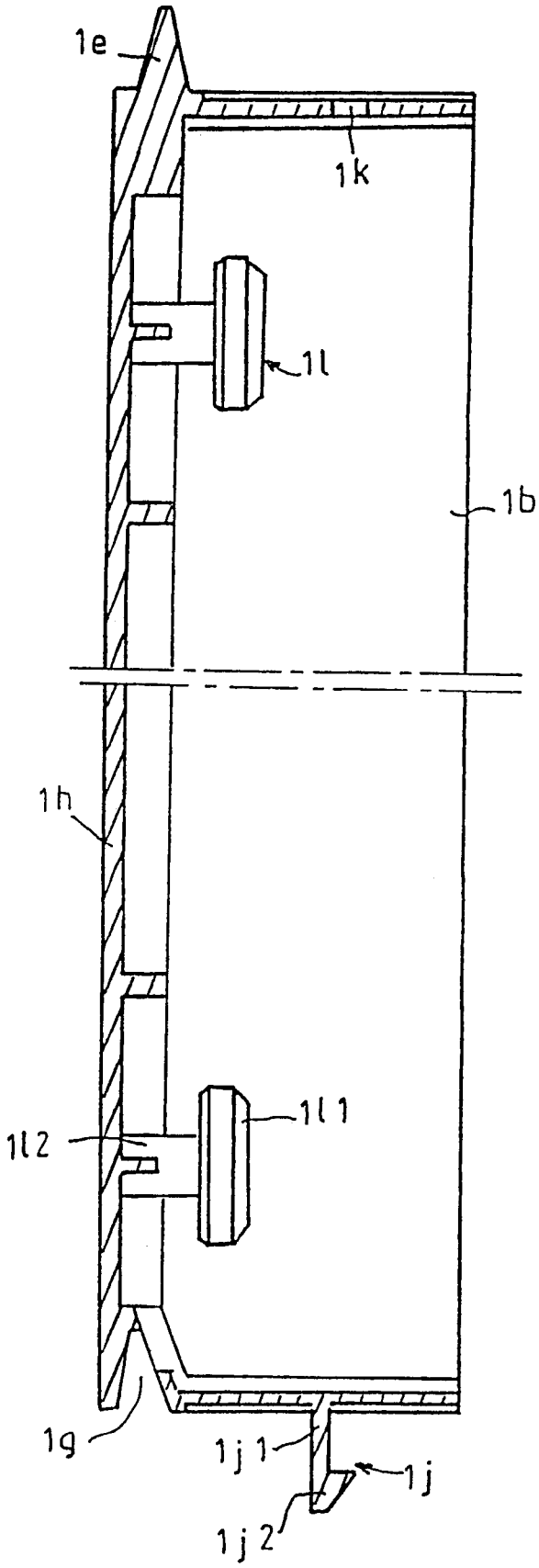
FIG. 3 is a transverse sectional view along line 3.3 in FIG. 2.
Figure 4:
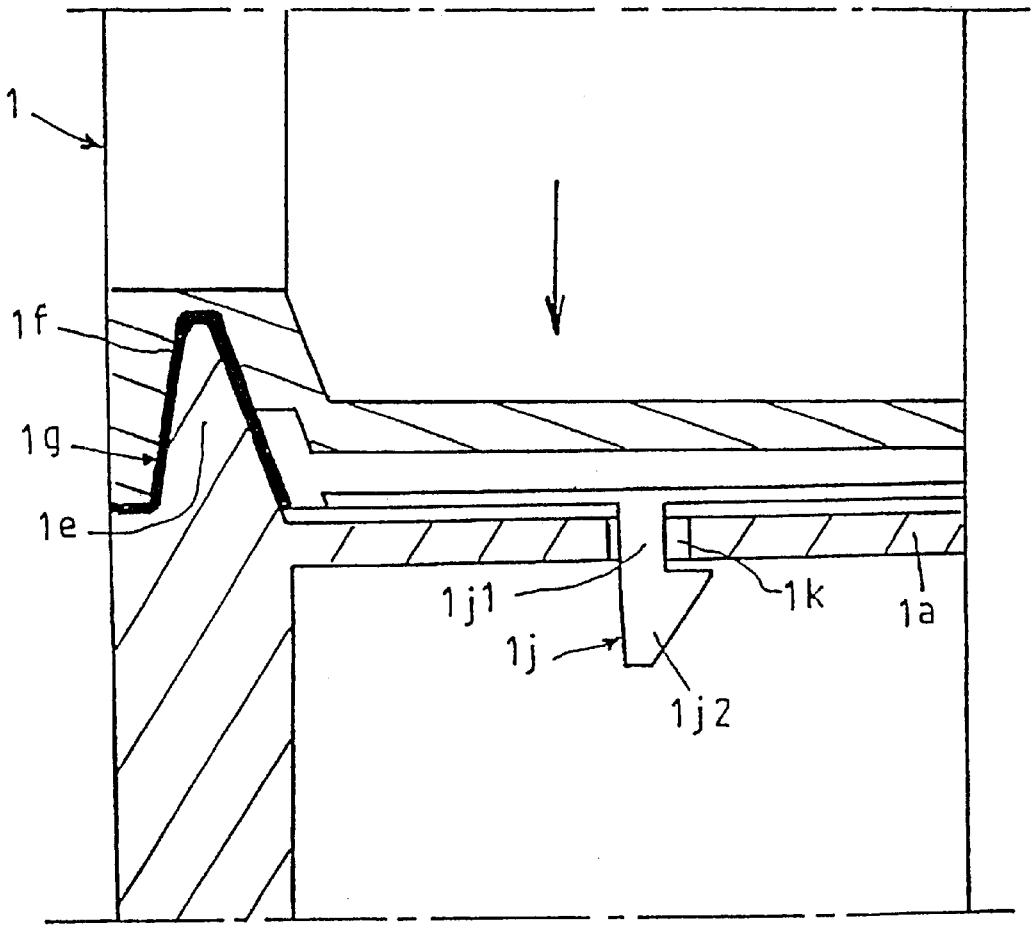
FIG. 4 shows how the panels are fitted together.
Figure 5:
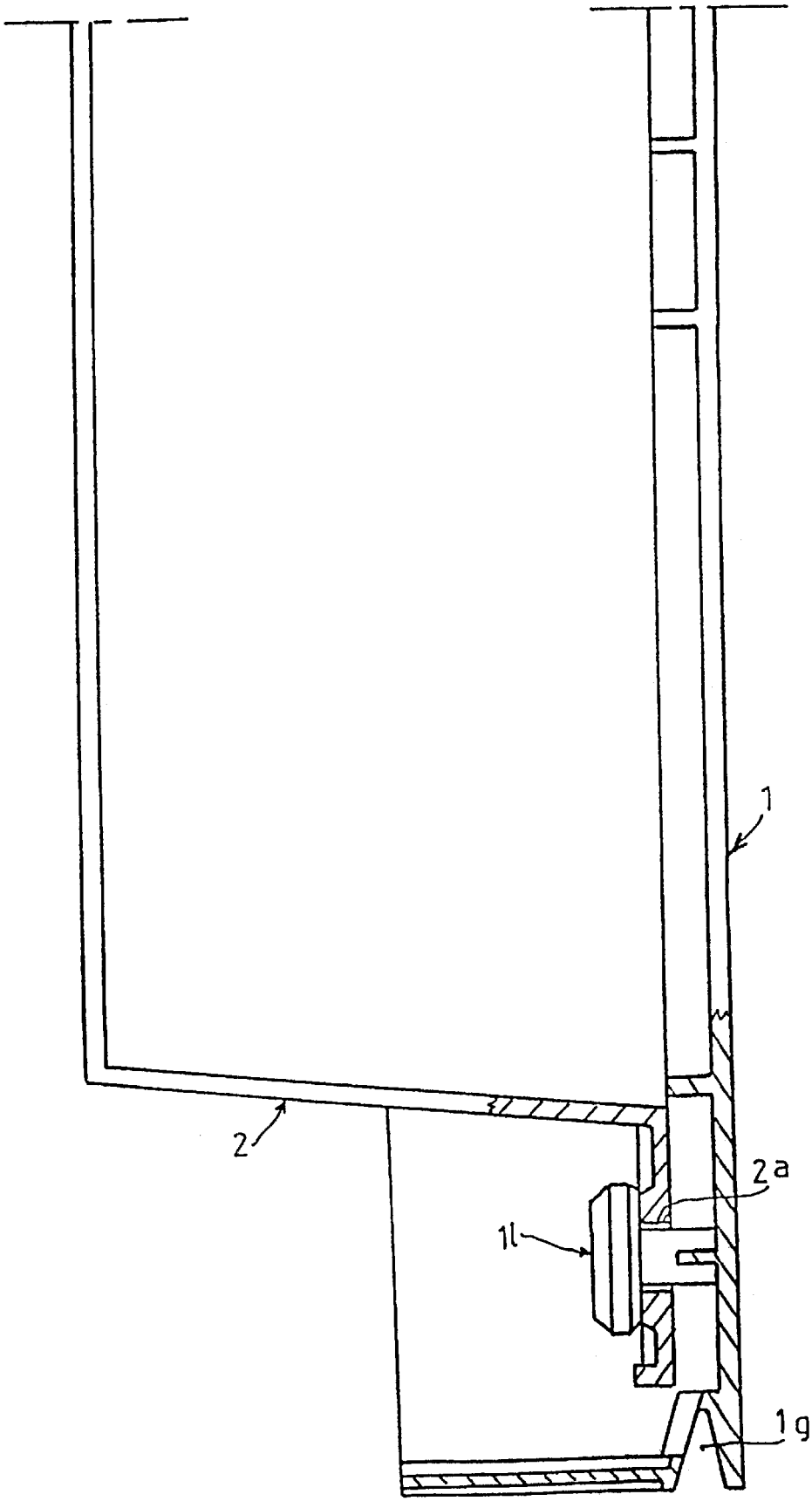
FIG. 5 is a longitudinal sectional view showing locking of the shaft elements relative to the modular element.

The reader is reminded that each panel is intended to produce, after assembly, a swimming pool (but not to the exclusion of other applications) and consists of an independent modular structure of generally rectangular shape. Each panel has a peripheral, stiffening assembly frame consisting of two vertical wings (1*a*) and (1*b*) and two horizontal wings (1*c*) and (1*d*). The height (h) of each element (1) is substantially four times its width (1). The basic design of this modular panel is that of the type defined in aforementioned Patent EP 382649.

According to one basic aspect of the invention, the vertical assembly wings (1*a*) and (1*b*) have features capable of ensuring instant assembly of juxtaposed pairs of modular panels and simultaneous sealing of the resulting joint area. For this purpose, one (1*a*) of the wings has, vertically over its entire height, a projecting profile (1*e*) that has a lateral sealing lip (1*f*). This assembly and sealing element has a transverse cross-section that is substantially triangular and is intended to cooperate with a slit of matching shape (1*g*) over the entire height of the other wing (1*b*). The profile (1*e*) and groove (1*g*) are close to the flat face (1*b*) of the panel as such.

In addition, face (1*a*) of each modular element (1) has, over its entire height and at regular or irregular intervals, a series of fastening tongues (1*j*) capable of co-operating with through holes (1*k*) formed in the thickness of the other wing (1*b*) in a corresponding manner. Each tongue (1*j*) has an area (1*j*1) for connection to the corresponding wing (1*a*) and its end is the actual fastening area (1*j*2). All the tongues (1*j*) and slots (1*k*) are located on the free end of the peripheral frame, i.e. that opposite the centring and sealing profiles and their corresponding groove (1*f*), (1*e*) and (1*g*).

Note that when the modular panels are placed side by side, on wings (1*a*) and (1*b*) of two adjacent panels, profiles (1*e*) are engaged in grooves (1*g*) and sealing lip (1*f*) is driven into said groove in order to ensure a perfect seal.

This position is secured by fitting fastening tongues (1*j*) into the matching openings (1*k*). It is also apparent that the vertical grooves (1*g*) may allow several angular variations after joining the panels side by side, thus making it possible to obtain swimming pool structures having various geometrical shapes.

According to another aspect of the invention, the inner face of the panel (1*h*) has two vertical rows of studs (11) parallel and close to vertical wings (1*a*) and (1*b*). The stud systems (11) are intended to cooperate with narrowed slots (2*a*) in each of support wings (2*b*) and (2*c*) of the reinforcing elements (2) that act as a shaft.

These elements (2), in a well-known manner, consist of a squared upper edge (2*d*) and a vertical trough (2*e*) formed between support wings (2*b*) and (2*c*). Trough (2*e*) is intended to be filled with concrete, as is squared edge (2*d*) which, after joining the modular panels (1) to each other, will constitute an anchorage.

The width of the shaft elements (2) substantially equals the width between the inner faces of assembly wings (1*a*) and (1*b*) of the basic modular element (1).

Each stud (11) has a head (111) and a centring part (112). The head (111) has an oblong shape the width of which substantially matches the width of the widest part of the narrowed slot (2*a*) and is angled at 90° relative to the latter. This head (111) is joined to centring part (112) in the form of a cylindrical pin that cooperates with the width of the smallest narrowed part of slot (2*a*). For example, each basic modular element (1) advantageously has five locking studs per row that consequently cooperate with three narrowed slots in the support wings of the elements that act as a shaft (2). It is therefore sufficient to fit the reinforcing elements (2) frontally relative to the inner face of the basic modular panels (1) in order to align the maximum width of the narrowed slot opposite the heads (111) of the studs and to drop element (2) in order to engage the cylindrical pin in the smallest part of the narrowed slot in order to ensure, by so doing, automatic, instant locking.

Note that, in order to prevent any inadvertent disassembly of the shaft relative to the panel, the latter may have, near at least one stud, a rib (1*n*) that presses against a hump on part of the shaft element.

The basic modular element (1) and the shaft element (2) are made of any material, especially plastic, and may be produced by any known, appropriate manufacturing process, in particular, elements (1) and (2) can be produced by injection moulding.

The advantages are clearly apparent from the description, the following points in particular being underlined and emphasised:

- instant, immediate fixing of juxtaposed basic modular panels without the need to use any separately mounted assembly fittings making it possible, at the same time as assembly, to obtain a perfectly leaktight joint.
- locking of the shaft elements relative to the basic elements without the need to use any external element.
- the speed of assembly and resulting reduction in installation costs,
- the simplicity of use,
- the effectiveness of the results obtained.

What is claimed is:

1. In a swimming pool, interlocking modular sections wherein each section includes:

- a flat rectangular panel having an outer face and an inner face,
- a rectangular frame extending outwardly from said inner face of said panel having vertical wings passing along the opposed side edges of said panel and horizontal wings passing along said top and bottom edges of said panels, said wings being perpendicular to said panel,
- one of said side wings having a vertically disposed profile that extends substantially along the length of said one side wing and protrudes outwardly from said one side wing,
- an opposite side wing having a vertically disposed groove that compliments the shape of said profile, said groove extending along the length of said opposite side wing whereby the profile of a first panel can be inserted into the groove of an adjacent panel to interlock the panels together in assembly,
- sealing means interposed between the profile and said groove to render the joint watertight,
- a reinforcing member secured to the inner face of the panel inside the frame, said reinforcing member having a vertical chamber extending along the length of said member and,
- a concrete column cast within said chamber.

2. The modular section of claim 5 further including a horizontally disposed chamber formed between the top surface of said reinforcing member and top wing of said frame, and a concrete beam cast within the horizontally disposed chamber.

3. The modular section of claim 5 wherein the inner face of said panel contains a series of mounting studs each having a body section and an expanded head at the distal end of said body section that, said studs adapted to mate with elongated holes in said reinforcing member, said elongated holes each having an expanded opening to permit the head of a stud to pass therethrough and a narrow slot for receiving the body sections of said stud therein.

4. The modular section of claim 5 wherein said profile has a truncated triangular shape.

* * * * *